US005326057A

United States Patent [19]

Lin

[11] Patent Number: 5,326,057

[45] Date of Patent: Jul. 5, 1994

[54] APPARATUS AND METHOD FOR DISPLAYING TWO DECORATIVE ITEMS AS A UNIT

[76] Inventor: Shou-Mei Lin, 11th Floor, 210 Nung An Street, Taipei, Taiwan

[21] Appl. No.: 58,200

[22] Filed: May 10, 1993

[51] Int. Cl.[5] ..... A47G 23/02

[52] U.S. Cl. ..... 248/152; 248/176; 248/309.1

[58] Field of Search ..... 248/146, 152, 154, 176, 248/314, 309.1; 211/89, 13; 40/607

[56] References Cited

U.S. PATENT DOCUMENTS

| | | | |
|---|---|---|---|
| 2,916,839 | 12/1959 | Wheaton | 40/143 |
| 3,811,565 | 5/1974 | Tancredi | 206/478 |
| 3,848,843 | 11/1974 | Levy | 248/224 |
| 4,910,901 | 3/1990 | Boyar | 40/607 |
| 5,127,616 | 7/1992 | Carney | 248/176 |

*Primary Examiner*—Ramon O. Ramirez

*Attorney, Agent, or Firm*—Griffin Butler Whisenhunt & Kurtossy

[57] ABSTRACT

An apparatus (10) and method for displaying two decorative items as a unit involves a U-shaped bracket (12) having a front arm (22) and a rear arm (24) interconnected at a base (26) with a middle attaching device (27, 27', 18, 20) at the base for mounting a pleated fan (54) between the arms and a pocket (50) attached to the second item (52), which can be a doll (52), which pocket is sized to snugly receive the front arm. In a preferred embodiment, there is further included an additional elastic band (16) adjacent a mouth (58) of the pocket on the second item which cooperates with edge notches (32, 34) in the front arm to ensure that the second item does not inadvertently fall off of the arm. In a preferred embodiment, the rear arm includes a device (48) for attaching the apparatus to a wall and the U-shaped bracket includes a means for supporting itself on a horizontal surface, with the two arms being vertically oriented.

18 Claims, 1 Drawing Sheet

APPARATUS AND METHOD FOR DISPLAYING TWO DECORATIVE ITEMS AS A UNIT

BACKGROUND OF THE INVENTION

This invention relates generally to the art of displaying decorative, or fanciful, goods and more particularly relates to a device which can be used for displaying two decorative items in a coordinated manner while still allowing the goods to be displayed individually, if desired.

Many different brackets and arrangements exist in the prior art for displaying items. For example, there are brackets which can be attached to walls which mate with counterpart brackets attached to items to be displayed (or used). For example, U.S. Pat. No. 3,848,843 to Levy and U.S. Pat. No. 2,916,839 to Wheaton disclose brackets for hanging items from walls. Similarly, there are many patents, such as U.S. Pat. No. 3,811,565 to Tancredi, which disclose supports and other devices for supporting items, such as dolls, from horizontal surfaces. However, there does not appear to be appropriate apparatus for selectively simultaneously displaying two items, in combination with one another. Thus, it is an object of this invention to provide an effective apparatus and method for selectively simultaneously supporting two items in coordination with one another.

A difficulty that is encountered in trying to design "ready-made" brackets and supports for supporting fanciful goods is that their users often like to apply their own creativity thereto. For example, under some circumstances, some people prefer to place fanciful, decorative items on horizontal surfaces such as tables, counters, and the like, while under other circumstances, they prefer to hang such items from walls. Therefore, it is an object of this invention to provide an apparatus and method which can be used to either support items on horizontal surfaces or hang them on walls, and which is effective when used in either manner.

Similarly, many people who display decorative items often wish to exchange the displayed items and/or to display the items in various ways. Therefore, it is an object of this invention to provide an apparatus and a method for displaying two decorative items, as mentioned above, but which can also be used with various types of decorative items, which can be used to display only one decorative item when desired, and/or which allows the items to be displayed individually where desired.

It is also an object of this invention to provide an apparatus and method for displaying two decorative items which employs a relatively inexpensive bracket and which is relatively easy for consumers to use.

SUMMARY

According to principles of this invention, an apparatus and method for displaying two decorative items involves a U-shaped bracket having a front arm and a rear arm interconnected at a base to form the shape of a U. The bracket includes a middle attaching device for attaching the first displayed item to the bracket at the base to hold the first displayed item between the front and rear arms. A pocket is attached to the second displayed item, which pocket is sized to snugly receive the front arm. Thus, the second device is supported on the front arm, with the arm extending into the pocket thereof.

The U-shaped bracket includes a wall-mounting device on the rear arm thereof, for attaching the rear arm to a wall, and lower horizontal support surfaces near the base thereof, for supporting the U-shaped bracket on a horizontal surface.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
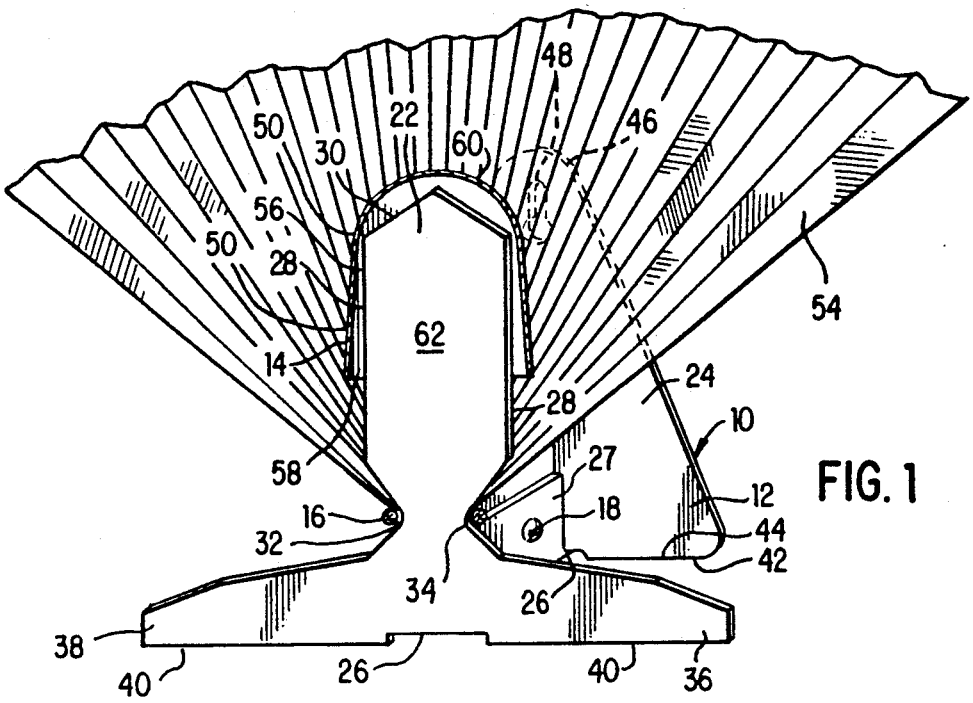
FIG. 1 is a cutaway, segmented, isometric view of two decorative items being displayed by an apparatus of this invention, the drawing being cutaway at line I—I in FIG. 2.

An apparatus 10 for displaying two items comprises a rather rigid U-shaped bracket 12, a pocket 14, an elastic-band loop 16 and a bolt 18 with an attached nut 20.

Figure 2:
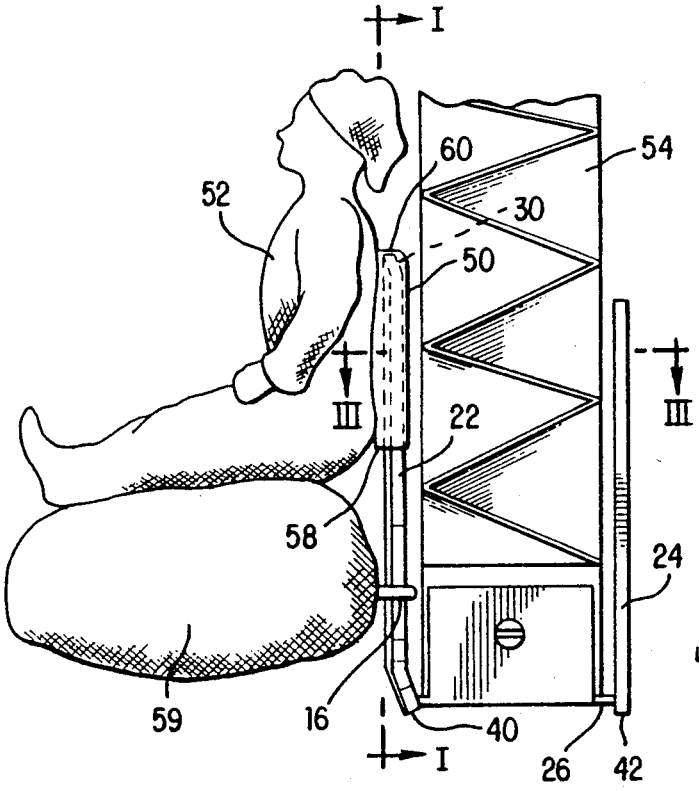
FIG. 2 is a segmented side view of two decorative items being displayed by an apparatus of this invention.
Figure 3:
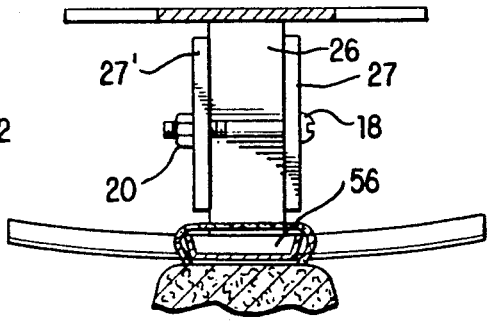
FIG. 3 is a view taken on line III—III in FIG. 2, but with the displayed items being removed.

The relatively rigid (usually made of metal) U-shaped bracket 12 includes a sheet-like (shaped wide and flat) front arm 22, a sheet-like rear arm 24 and a sheet-like base 26 interconnecting the front and rear arms 22 and 24. The front arm 22 has close-to parallel lateral edges 28 near an outer end 30 thereof which lateral edges 28 have opposite notches 32 and 34 therein near the base 26. But at the base 26, the front arm 22 flares laterally to form right and left front horizontal support portions 36 and 38. It can be seen in FIG. 2 that lower surfaces 40 of the right and left front horizontal support portions 36 and 38 are positioned slightly below the base 26.

Similarly, horizontal support surfaces, lower surfaces 42, of the triangularly-shaped rear arm 24 also are positioned slightly below the base 26 and are aligned with the lower surfaces 40 of the front arm 22 so that the lower surfaces 40 and 42 of the front and rear arms 22 and 24 form horizontal support surfaces for the U-shaped bracket 22 and anything it supports.

The rear arm 24 has the triangular shape with the base edge 44 thereof being wide and an outer end 46 thereof forming a narrow apex of the triangle. The rear arm 24 has a fastener slot 48 therein for receiving a fastener to fasten the U-shaped bracket to a wall.

The U-shaped bracket 12 is formed of one piece of sheet metal, with the base 26 extending between the front and rear arms 22 and 24. Also included on the U-shaped bracket 12, as part of a middle attaching device, are sheet-like right and left middle uprights 27 and 27', which are formed as one piece with the U-shaped bracket 12. These members extend away from the flat base 26 in the same direction of extension as the front and rear arms 22 and 24, however, they are arranged to be perpendicular to planes of the relatively flat, sheet-like, front and rear arms 22 and 24, but approximately parallel to one another. The bolt 18 extends through holes in the right and left middle uprights 27 and 27' and it is held therein by its head at one end and the nut 20 screwed to the other end, both being positioned outside surfaces of the middle uprights 27 and 27'.

The apparatus for displaying two decorative items further includes a pocket 50 which is attached to a second displayed item 52, and which, in the case of the depicted embodiment is a doll. The first displayed item in the depicted embodiment is a pleated fan 54. The pocket 50 is sized to form a pocket cavity 56 which can snugly receive, through a mouth 58 of the pocket 50, the outer end 30 of the front arm 22.

The apparatus for displaying two decorative items further includes the elastic band loop 16, which is also attached to the second displayed item 52 at a pillow 59 on which the doll 52 sits. The pocket 50 and the elastic band loop 16 are aligned so that the front arm 22 can pass through the loop 16 and the mouth 58 into the pocket cavity 56. Further, the elastic band loop 16 and the pocket 50 are spaced from one another so that when the outer end 30 of the front arm 22 is at a closed end 60 of the pocket 50, the elastic band loop 16 is positioned approximately at the opposite notches 32 and 34 in the front arm 22.

Describing now a normal method of using the apparatus of this invention for displaying two decorative items, a U-shaped bracket, such as the bracket 12 in the drawings is provided. A first displayed item, such as the pleated fan 54, is mounted on the base 26 of the U-shaped bracket 12 between the front and rear arms 22 and 24 by means of the middle attaching device comprising the right and left middle uprights 27 and 27' and the bolt and nut 18 and 20. In the depicted case, an end of -the pleated fan 54 is pressed together and inserted between the right and left middle uprights 27 and 27'. The bolt 18 is then passed through the right and left middle uprights 27 and 27' and the compressed portion of the pleated fan 54, that is through holes therein. The nut 20 is then fastened to the bolt 18 to maintain all these elements in this attitude. The pocket 14 is attached to the second displayed item 52 as is the elastic band loop 16. Again, these members are attached to the second displayed item 52 with the elastic band loop 16 being aligned with the mouth 58 of the pocket 50 and with the elastic band loop 16 being spaced from the pocket 50 so that the elastic band loop 16 will be positioned at the opposite notches 32 and 34 when the outer end 30 of the front arm 22 is at the closed end 60 of the pocket 50.

The second displayed item 52 or the U-shaped bracket 12 is then manipulated so that the front arm 22 passes through the elastic band loop 16 and into the mouth 58 of the pocket 50 until the outer end 30 of the front arm 22 is at the closed end 60 of the pocket 50.

The two items 52 and 54 are now arranged in a particular configuration relative to one another and the entire arrangement can either be supported on a wall by passing a fastener through the fastener slot 48 in the rear arm 24, or from a horizontal surface, by placing the lower support surfaces 40 and 42 of the front and rear arms 22 and 24 on a horizontal surface.

It will be appreciated by those of ordinary skill in the art that the U-shaped bracket of this invention, in cooperation with a pocket attached to a second item to be displayed, provides a handy device for selectively displaying items. In this respect, a front surface 62 of the front arm 22 can also be made to be quite attractive so that the U-shaped bracket 12 can be used to display only the first displayed item, that is the fan 54, without being used to display the second displayed item, that is the doll 52.

In a similar manner, although the U-shaped bracket and pocket allow two decorative items to be displayed as a single unit, they do so without significantly altering the two displayed items. That is, the two displayed items retain the "freedom" to be used and/or displayed on their own. In this regard, there exists in the prior art many examples of two or more items which are displayed together as a unit; however, this is usually accomplished by gluing or permanently affixing one of the items to the other. Thus, in order to display such prior-art items individually, it would be necessary to forcibly separate them, which may alter them. With the U-shaped bracket and pocket of this invention, one has the ability to either independently display items or to display them in a combination.

In the described embodiment of this invention, the pleated fan serves as a backdrop to the doll. However, in an alternate embodiment, the first item, that is the backdrop item, could be a spray of artificial flowers, or a flower arrangement. Similarly, it is not necessary that the fan be pleated or that the first item be a fan. The first item could, for example, be a decorative screen. Also, the front, or second, item need not be a doll, but could rather be a flower receptacle having the pocket thereon.

It will also be recognized by those of ordinary skill in the art that the U-shaped bracket 12 can be made with different types of middle attachment devices rather than those having the right and left middle uprights 27 and 27'. That is, for example, a screw could be passed through the base 26 into a first displayed item to hold this item between the front and rear arms 22 and 24.

Further, it is highly beneficial that the U-shaped bracket includes the laterally extending front and rear horizontal support portions 36 and 38 which form the "outrigger" lower surfaces 40 and 42 to provide a stable support for the U-shaped bracket 12 when it is placed on a horizontal surface.

It is significant that the front arm 22 has relatively parallel lateral edges 28 near an outer end 30 thereof which can snugly fit side edges of the pocket 50, because in this manner the second displayed item 52 is held thereby laterally stable.

Similarly, it is helpful to have the elastic band loop 16, which is only slightly longer than the width of the front arm 22 at the notches 32 and 34, for cooperating with the notches 32 and 34 in the lateral edges of the front arm 22 to also aid in lateral stability of the second displayed item 52 and for preventing the second displayed item 52 from falling off the U-shaped bracket. For example, when the entire assembly is shipped in a package with the second displayed item 52 being attached to the front arm 22, it is not desirable for the second displayed item 52 to fall from the front arm 22 when the entire assembly is removed from its packaging. On the other hand, by making the loop 16 of an elastic material, the loop can be expanded to be as wide as the front arm 22 at the parallel lateral edges 28 for removing the second displayed item 52 therefrom when this is desired.

Yet another benefit of this invention is that it is attractive from all angles, so that it can be placed on a horizontal surface on which it can be viewed both from the front and from the back.

It will be recognized by those of ordinary skill in the art that an apparatus of this invention for displaying decorative items works particularly well for displaying open pleated fans behind second items. This is a particularly attractive arrangement.

While the invention has been particularly shown and described with reference to a preferred embodiment, it will be understood by those of ordinary skill in the art that various changes in form and detail may be made therein without departing from the spirit and scope of the invention.

For example, the middle attachment device can be completely different from that disclosed. Further, the U-shaped bracket can have other configurations from that shown, however, the configuration shown is particularly stable, attractive from all angles and provides good lateral support for two displayed items from both horizontal surfaces and vertical walls.

The embodiments of the invention in which an exclusive property or privilege are claimed are defined as follows:

1. Apparatus for displaying two items adjacent one another, said apparatus comprising:

a U-shaped bracket having a front arm and a rear arm interconnected at a base to form the shape of a U, said bracket including a middle attachment means for attaching said first displayed item to said bracket between said front and rear arms for holding said first displayed item between said front and rear arms;

a pocket attaching means for attaching to said second displayed item and. for forming a pocket cavity thereon for receiving said front arm so that said pocket attaching means can support said second displayed item on said front arm adjacent said first displayed item.

2. Apparatus as in claim 1 wherein said middle attaching means is mounted on said base.

3. Apparatus as in claim 2 wherein said middle attaching means includes two, approximately parallel, sheet-like members extending away from said base in a direction in which said front and rear arms extend but to be approximately perpendicular to said front and rear arms.

4. Apparatus as in claim 1 wherein said front and rear arms have sheet-like shapes, but are substantially wider at portions thereof near said base than at outer ends thereof positioned away from said base so as to form stable lower support surfaces.

5. Apparatus as in claim 4 wherein said middle attaching means includes two, approximately parallel, sheet-like members extending away from said base in a direction in which said front and rear arms extend but to be approximately perpendicular to said front and rear arms.

6. Apparatus as in claim 1 wherein said pocket attaching means is mounted on said front arm.

7. Apparatus as in claim 6 wherein is further included an elastic band loop attached to said second displayed item adjacent a mouth of said pocket and wherein said front arm has a sheet-like shape, but with notches in opposite lateral edges thereof which are positioned at said elastic band loop.

8. Apparatus as in claim 1 wherein is further included an elastic band loop attached to said second displayed item adjacent a mouth of said pocket and wherein said front arm has a sheet-like shape, but with notches in opposite lateral edges thereof which are positioned at said elastic band loop.

9. An assembly for displaying a second displayed item in coordination with a pleated fan comprising:

said pleated fan;

a U-shaped bracket having a front arm and a rear arm interconnected at a base to form a U, said bracket including a middle attaching means for attaching said fan to said bracket for holding said pleated fan between said front and rear arms;

a pocket attaching means for attaching to said second displayed item and for forming a pocket cavity thereon for snugly receiving said front arm so that said pocket attaching means can support said second displayed item on said front arm adjacent said fan.

10. An assembly as in claim 9 wherein said middle attaching means is mounted on said base.

11. An assembly as in claim 9 wherein said middle attaching means includes two, approximately parallel, sheet-like members extending away from said base in a direction in which said front and rear arms extend but to be approximately perpendicular to said front and rear arms.

12. An assembly as in claim 9 wherein said front and rear arms have sheet-like shapes, but are substantially wider at portions thereof near said base than at outer ends thereof positioned away from said base so as to form stable lower support surfaces.

13. An assembly as in claim 9 wherein said middle attaching means includes two, approximately parallel, sheet-like members extending away from said base in a direction in which said front and rear arms extend but to be approximately perpendicular to said front and rear arms.

14. An assembly as in claim 9 wherein said pocket attaching means is mounted on said front arm.

15. An assembly as in claim 9 wherein is further included an elastic band loop attached to said second displayed item adjacent a mouth of said pocket and wherein said front arm has a sheet-like shape, but with notches in opposite lateral edges thereof which are positioned at said elastic band loop.

16. An assembly as in claim 9 wherein is further included an elastic band loop attached to said second displayed item adjacent a mouth of said pocket and wherein said front arm has a sheet-like shape, but with notches in opposite lateral edges thereof which are positioned at said elastic band loop.

17. A method of displaying two items, one in front of the other, comprising the steps of providing a U-shaped bracket having a front arm and a rear arm interconnected at a base to form a U, said bracket including a middle attaching means for attaching the first displayed item to the bracket for holding the first displayed item between the front and rear arms;

attaching a pocket to the second displayed item in such a manner that the pocket forms a pocket cavity sized to receive the front arm;

attaching the first displayed item to the base using the middle attaching means;

sliding the pocket, which is attached to the second displayed item, onto the first arm.

18. An apparatus as in claim 17 wherein is further included the step of attaching an elastic loop to the second displayed item adjacent a mouth of the pocket and providing lateral notches in the front arm to be positioned at the elastic loop when the pocket is on the front arm so that the elastic loop will hold the second displayed item on the front arm.

* * * * *